US005117768A

United States Patent [19]

Seymour

[11] Patent Number: 5,117,768

[45] Date of Patent: Jun. 2, 1992

[54] THREE ROLL COATING MACHINE WITH PNEUMATIC AND MICRO CONTROLLED OFFSET ROLL

[75] Inventor: Ronald P. Seymour, Bay City, Mich.

[73] Assignee: Euclid Tool & Machine Co., Bay City, Mich.

[21] Appl. No.: 659,903

[22] Filed: Feb. 25, 1991

[51] Int. Cl.[5] ..... B05C 1/08

[52] U.S. Cl. ..... 118/249; 101/247; 118/258; 118/261

[58] Field of Search ..... 118/249, 258, 261; 101/247, 153, 152

[56] References Cited

U.S. PATENT DOCUMENTS

| | | | |
|---|---|---|---|
| 3,150,002 | 9/1964 | Justus | 118/249 |
| 3,379,170 | 4/1968 | Thomas et al. | 118/261 |
| 3,676,184 | 7/1972 | Spearin . | |
| 3,738,265 | 6/1973 | Saueressig | 101/152 |
| 4,251,566 | 2/1981 | Gingerich | 427/10 |
| 4,413,541 | 11/1983 | Biggar, III | 101/247 |
| 4,495,886 | 1/1985 | Phelps | 118/249 |
| 4,524,712 | 6/1985 | Ito | 118/249 |
| 4,737,378 | 4/1988 | Narita | 427/8 |
| 4,913,084 | 4/1990 | Seymour | 118/123 |

FOREIGN PATENT DOCUMENTS

| | | | |
|---|---|---|---|
| 0453300 | 12/1948 | Canada | 118/249 |

*Primary Examiner*—Karen M. Hastings

[57] ABSTRACT

This invention relates to an improved three roll coating machine that is useful in coating various substrates with various coating materials. The key to the improvement in the machine is the use of a pneumatically controlled application blade in conjunction with a new and novel pneumatically and micro controlled offset roller.

1 Claim, 2 Drawing Sheets

THREE ROLL COATING MACHINE WITH PNEUMATIC AND MICRO CONTROLLED OFFSET ROLL

This invention deals with an improved three roll coating machine which has all the advantages of a machine with a pneumatically controlled application blade while gaining the advantage of having a pneumatically and micro controlled offset roll to help control the ultimate thickness of any coating applied to a substrate using the improved three roll coating machine and allowing for the exact reposition of the roll in its coating position after the roll has been moved from its coating position for cleaning or the like.

FIELD OF THE INVENTION

This invention relates to an improved three roll coating machine that is useful in coating various substrates with various coating materials. The key to the improvement in the machine is the use of a pneumatically controlled application blade in conjunction with a new and novel pneumatically and micro controlled offset roller.

A large majority of the coating machines that are in existence today are used primarily for the application of moderately viscous materials to various substrates, mainly, paper substrates. The most critical part of such a machine is the coating knife.

However, in the production of thick films, such as from foams or gells, or high viscosity coatings, the action of the coating knife along with the action of the offset, or transfer coating roll is the most critical part of such a machine as the knife controls the initial wet thickness of the coating material on the coating roll and then the offset roll essentially picks up the coating material from the coating roll, transfers some of the coating to itself, and then applies the coating to the substrate under the pressure of a nip roll. The transfer roll essentially splits the amount of material on the coating roll and transfers it to the substrate. This action is critical for uniform coating and is especially critical with thick materials.

Just recently, the inventor herein issued a patent, U.S. Pat. No. 4,913,084, issued on Apr. 3, 1990 which deals with an improved, pneumatically controlled applicator knife mechanism which was found useful for controlling the thickness of coatings on various substrates. This knife has found utility in all types of coating devices, as the pneumatically controlled applicator knife gave the operator an improved amount of precision control while applying coatings to substrates.

There have been disclosed in the prior art various devices for controlling the thicknesses of coatings on certain substrates.

One such disclosure can be found in U.S. Pat. No. 4,251,566 to Gingerich which issued Feb. 17, 1981, wherein the thickness of coating is controlled by the adjustment of a regulator roller by the use of a motor which drives a shaft. This device suffers from lack of precision and does not appear to have any means of adjusting the regulator roller back to its original position relative to the coater roller after the regulator roller has been moved away from the coater roller.

U.S. Pat. No. 3,676,184, which issued Jul. 11, 1972, to Spearin et al, deals with a lever system actuated by a piston-cylinder arrangement to move the applicator roll from one position to another position. The device operates to move the coating roller into and out of the coating position, but does not appear to have any sensitivity control and does not appear to have the capability of returning the applicator roll to its original coating position with precision.

Finally, U.S. Pat. No. 4,737,378, which issued Apr. 12, 1988, to Nairta et al, deals with a sophisticated computer memory system to keep coating rolls in parallel with any backing and nip rolls used in the device. The rolls are mounted in slider bars and are driven by a driving means which are pulse motors or the like.

This patent seems to deal with the electronics of being able to keep track of both ends of the rolls and adjusting them to keep the roll parallel with any surface that is desired. The actual drive mechanism and control of the drive mechanism seems to have been left to the very imprecise pulse motors.

The instant invention deals with a pneumatically and micro controlled offset roll which is used in a three roll coating apparatus and which overcomes all of the problems associated with the prior art devices. Not only is the instant invention capable of pneumatically driving the coating knife apparatus and not only is the instant invention capable of pneumatically driving the offset roll to control the thickness of the coatings, but the micro control system is capable of returning the offset roll to exactly where it was during the coating operation in order to ensure that the coating continues to be the exact same uniform thickness without the sophisticated and expensive computer controls of the Narita et al system.

Thus, the instant invention deals with a simple control system that when used with conventional three roll coating machines, gives thin, fine, uniform coatings without the concomittant problems associated with the use of the prior art devices. Furthermore, with the exception of the Narita et al sophisticated computer system, none of the prior art devices allows the operator to position the offset roller out of the way for cleaning, and then, return the offset roller to exactly the same position as it occupied during the coating operation. None of the devices of the prior art have this capability and precision with essentially mechanical means. The instant invention provides a low cost method of obtaining precision in the thickness of the coating and at the same time, precision for the return of the offset roller to the coating position it occupied during the coating operation.

THE INVENTION

The instant invention overcomes the problems of the prior art machines and provides new and novel control mechanisms for offset rolls for three roll coating machines.

Specifically, the instant invention deals with a pneumatically and micro controlled offset roll suitable for encasement in three roll coating machines, said offset roll and controls in combination comprising an offset roll which comprises a cylinder having an axle though its longitudinal center and extending some distance therebeyond, said cylinder having a hard outer coating; said axle having mounted near each of its ends thereof, a bearing; each end of said axle being rotatably mounted into an L-shaped slide block; each said slide block being slidably mounted in a slide case, said slide case being fixedly attached in essentially a vertical position on the outside surface of the encasement; said slide block having mounted in its upper surface a rod, said rod being a slide rod of a pneumatically driven piston; said piston being fixedly mounted on the outside wall of the encasement by a first bracket; said slide block having fixedly mounted through the leg of the L-shape slide block and essentially in a downwardly configuration, a micrometer adjustment device having an elongated rod on its lower end having machine threads on its outside surface and fixedly attached to a micrometer adjustment knob on its upper end, said threaded elongated rod being adjustably mounted into an essentially free floating adjustable stop block; said stop block having fixedly mounted into its end distal from the inserted, threaded, elongated rod, a first button stop, and said encasement having mounted on its lower outside surface, and in supporting alignment with the L-shaped slide block, a second bracket, said second bracket having fixedly mounted on its upper surface, a second button stop in alignment with the first button stop.

A further aspect of the instant invention is an improved three roll coating machine for applying coatings to a substrate, wherein the three roll coating machine comprises in combination an encasement for supporting, and mounted in the encasement, a pneumatically controlled thin flexible blade mounted in a blade holder with a blade retainer, the blade having attached thereto at least two vertical dams; a drive roll; a drive means for the drive roll; a nip roll and an offset roll, the improvement comprising a pneumatic control in combination with a micro control for the offset roll.

BRIEF DESCRIPTION OF THE DRAWINGS

This invention will be described with reference to the accompanying drawings, which are illustrative of the embodiments of the invention falling within the scope of the appended claims, and in which:

DESCRIPTION OF THE PREFERRED EMBODIMENTS OF THE INVENTION

Figure 1:
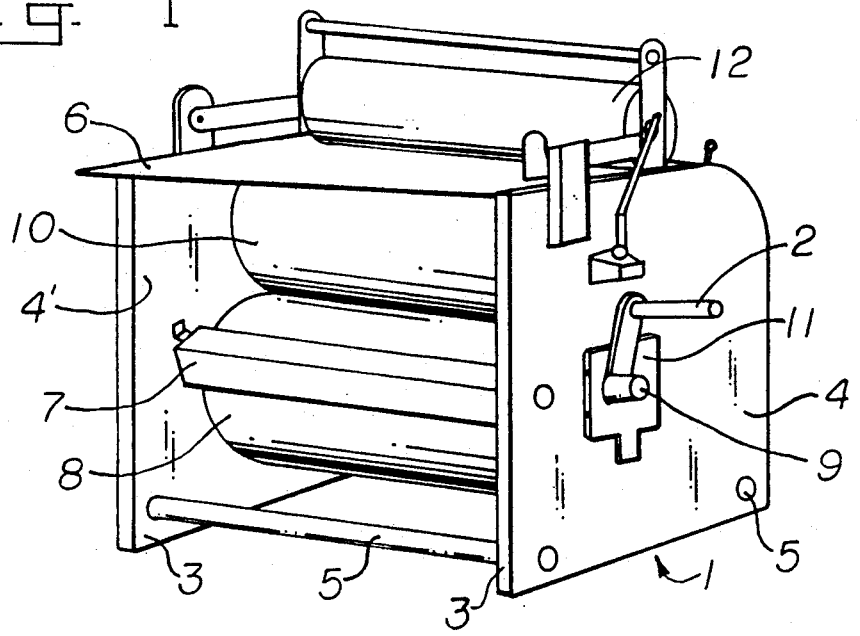
FIG. 1 is a full view in perspective of a typical prior art bench top three roll coating machine.

Referring now to FIG. 1, wherein there is shown a full view in perspective of a three roll coating machine 1 of the prior art which is driven with a manually operated turning handle 2, there is shown an encasement 3 comprising two side walls 4 and 4' having supporting rods 5 and 5' (5' not shown in full) and a paper loading tray 6, which is supported on four pins (which are not shown) for easy removal and replacement or cleaning.

In addition to the encasement 3, there is shown the various operating elements of the machine such as an applicator knife blade apparatus 7, for determining the thickness of the wet coating on the coating roll 8, which roll is supported in the encasement, from side to side, by an axle 9 which turns on bearings, not shown. Also shown is the offset roll 10. There is a drive mechanism 11 which is attached to the drive handle 2. By turning the handle, the coating roll 8 is turned. As the coating roll 8 turns, it picks up the material to be coated from a pool of such material placed between the coating roll 8 and the knife apparatus 7, the knife apparatus 7 determining how much of the pool of material is picked up and dressed on the coating roll 8. Surmounting the offset roll 10 is a nip roll 12, which compresses any substrate fed through the tray 6 against the offset roll 10.

In summary then, a pool of material is placed between the knife apparatus 7 and the coating roller 8 and upon turning the handle 2, the coating roll 8 turns, which in turn turns the offset roll 10. A substrate to be coated is passed across the top of the tray 6 whereupon it passes over offset roll 10 while at the same time it is compressed by the weight of the nip roll 12, and the coating material transfers unto the substrate from the offset roll 10. As a consequence of passing between the nip roll 12 and the offset roll 10, the paper moves out of the machine, all of the above intended to give those less skilled in the art the general operation of the devices of the prior art and to understand the placement of the offset roll in such devices, and to understand the problems that can be associated with this type of apparatus.

Figure 2:
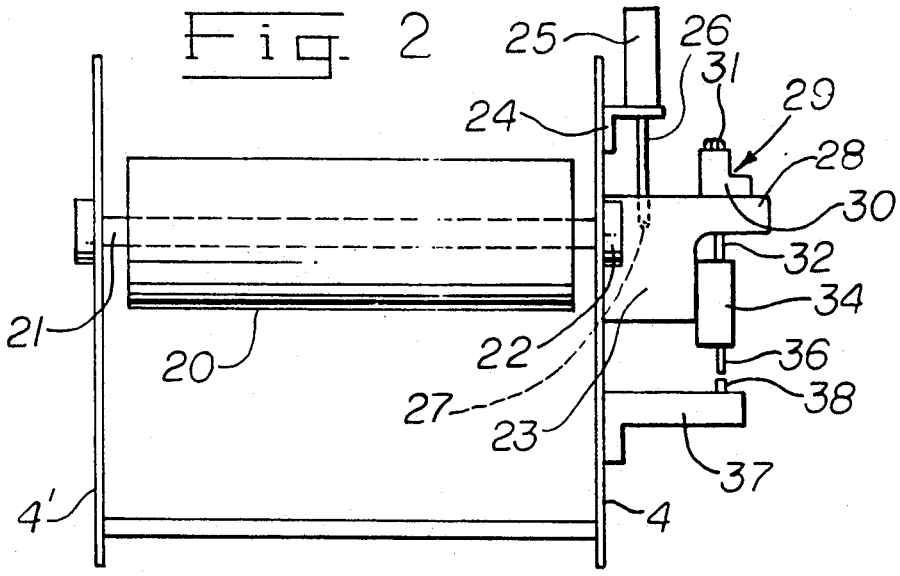
FIG. 2 is a full view of the front of a three roll coating machine with all of the elements removed except the offset roll and the accoutrements associated with the instant invention, to show the alignment of the elements of the instant invention relative to each other.

Now, turning attention to the device of the instant invention and with reference to FIG. 2, there is shown a full view of the front of a three roll coating machine with all of the elements removed except the offset roll and the accoutrements associated with the instant invention, to show the alignment of the elements of the instant invention relative to each other.

It should be especially noted that the coating roll, knife apparatus and nip roll, among other elements of the prior art devices are not shown so that focus can be had on the controls of the instant invention, it being understood that the inventor herein contemplates that one aspect of his invention comprises a fully operational three roll coating machine with all of the convention1 elements in addition to the substitution of the control system disclosed herein for the stabilized offset roll of the prior art device.

In FIG. 2 there is shown some of the elements of the instant invention. There is shown an offset roll 20, an axle 21 for the offset roll 20; slide case 22; slide block 23; mounting bracket 24; pneumatic cylinder 25; piston rod 26; L-shaped configuration 28 of the slide block 23; micrometer adjusting device 29, having a housing 30 and an adjustable rod 32; an adjustable stop block 34; a first stop button 36; a supporting bracket 37; a second stop button 38, and a wear plate 39 (shown in FIG. 3 and also in FIG. 6.)

Figure 3:
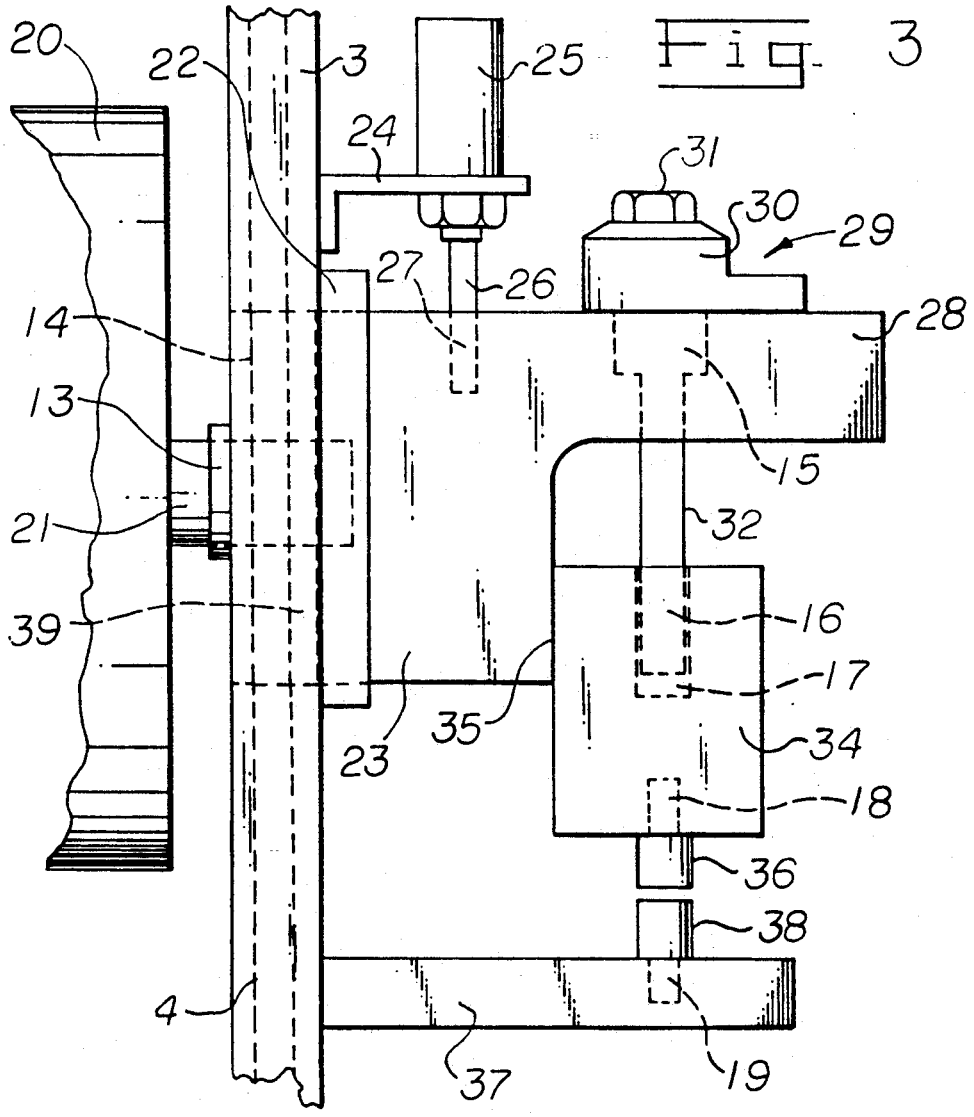
FIG. 3 is blowup of the critical elements of the instant invention showing the details of the controls.

In FIG. 3 there is shown in an enlarged view, some of the elements of the encasement 3, namely a wall 4, for perspective, along with an offset roll of the instant inventive device 20, and the elements which make up the control part of the invention herein. The control elements are shown only on the right hand side of the machine, it being understood that for purposes of this invention, a similar set of elements would be on the left side of the machine as well.

Figure 4:
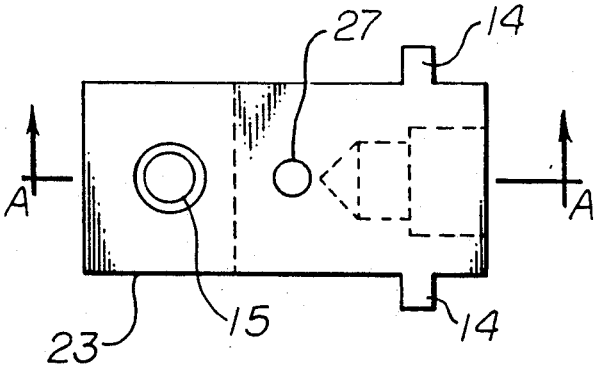
FIG. 4 is a top view of the L-shaped sliding block of this invention.
Figure 5:
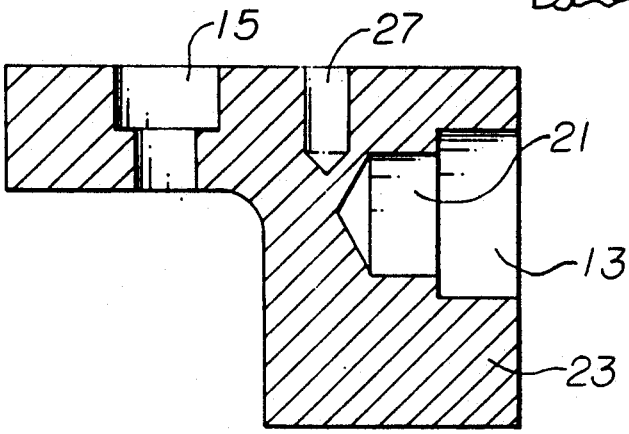
FIG. 5 is a sectional side view of the sliding block with a cut through line A—A of FIG. 4.

In FIG. 3, there is shown an offset roll 20, comprising a hollow cylinder having an axle 21, through its longitudinal center and extending some distance beyond the end of the cylinder. The offset roll 20 is supported by the encasement 3 by the use of bearings 13 mounted on each of its ends to facilitate the turning of the axle 21 in the encasement 3. Also shown in FIG. 3 is a slide case 22 which will be discussed in more detail infra. The slide case 22 has associated with it a slide block 23, which has slide rails shown in phantom as 14, shown in clearer detail in FIGS. 4 and 5 and discussed in detail infra, which are adapted to fit into the slide case 22 and slidably mate therewith. In this view, it should be noted that the slide block 23 has an L-shaped configuration 28 such that the L portion of the slide block 23 extends away from the encasement 3. Solidly mounted to the outside surface of the encasement 3 is a mounting bracket 24 which supports a pneumatic cylinder 25, containing a piston rod 26, all of which is part of the driving mechanism for part of the control mechanism for this invention. The pneumatic cylinder 25 is mounted in the bracket 24 such that the piston rod 26, protrudes through the bracket 24 and extends essentially downwardly to the top of the sliding block 23 where it is inserted into a hole 27, shown in phantom, drilled and tapped into the top of the slide block 23 (see FIG. 4 for further detail). The piston rod 26 must be free to move without obstruction from the bracket 24, while the pneumatic cylinder 25 must be secured to the bracket 24 to firmly hold it in place.

Still, with reference to the slide block 23, in FIG. 3, there is shown a micrometer adjusting device 29, which is mounted in the L-shaped configuration 28 such that it is essentially parallel with the pneumatic cylinder 25. The micrometer adjusting device 29 is mounted such that its housing 30 is solidly fixed to the L-shaped configuration 28 and is countersunk as shown at 15, into the upper surface of the L-shaped configuration 28.

The micrometer adjusting device 29 comprises a precision control means consisting of a micro adjustment dial 31, which has inscribed micrometer measurements on it, and a piston or rod 32, which is threaded on its lower portion at 16 and is allowed to drive free of the L-shaped configuration 28 by the rotation of the micro adjustment dial 31. When the dial 31 is turned to the right, the rod 32 moves upward towards the dial 31 and housing 30, and when the dial 31 is turned to the left, the rod 32 is moved downwards, away from the dial 31 and the housing 30.

The significance of this micrometer rod adjustment can be determined by making reference to the adjustable stop block 34 which interfaces with and slides along the slide block 23 as shown at 35. The adjustment capability of the adjustable slide block 34 is accomplished by threading the rod 32 into a drilled and tapped hole 17 in the top of the adjustable stop block 34 such that the adjustable slide block 34 is secured to the rod 32. When adjustments are made by rotating the dial 31, the rod 32 moves up or down and thereby moves the adjustable stop block 34 up or down.

Securely mounted in a hole 18 in the end of the adjustable stop block 34, distal from the rod 32, is a first stop button 36. There is securely mounted below the adjustable stop block 34, on the exterior surface of the encasement wall 4', a second bracket 37, which is used to support a second stop button 38, the second stop button 38 being securely mounted in a drilled and press fit hole 19.

Figure 6:
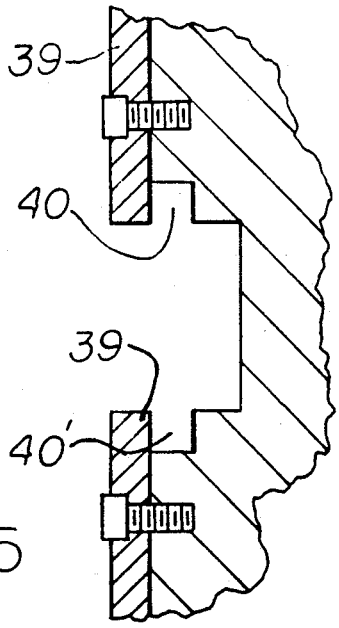
FIG. 6 is a top cross-sectional view of part of the wear plate of the the slide block to show the internal configuration thereof.

The wearplate 39 of the slide case 22 is shown in FIG. 6 to illustrate its association with the configuration of slide block 23. The wear plate 39 has slide grooves 40 which mate with the slide rails 14 of the slide block 23. Elements 40 and 40' are machined into the wall 4 of the wearplate 39 in such a manner that the elements 40 and 40' contains slide rails 14 in a tight tolerance fit such that the slide rails 14 move across the elements 40 and 40' in a smooth sliding motion. Throughout this disclosure, the inventor has made reference to the elements of this inventive device as though they were assembled onto the encasement 3 in essentially a vertical position. However, for best operation, the control elements of this invention are assembled on the three roll coating machine at an angle of about 30° off vertical, to accomodate the alignment of the remainder of the elements of the device, it being understood that the rolls of such a device do not ordinarily align vertically with each other but are normally offset from each other to some degree.

In operation, the offset roll slidably moves in essentially a vertical motion, it being mentioned that for purposes of this invention, that is about 30° from the vertical, and that the offset roll is driven by a pneumatic cylinder and rod mechanism through the use of a sliding block, which also has attached to it an adjustable micrometer and sliding block whose movement is guided by a stop mechanism. The knife blade apparatus is adjusted to give the required wet coating thickness on the coating roll and then the operator can adjust the micrometer for the desired thickness of the coating to be transferred from the coating roll to the offset roll, and the coating of the substrate is undertaken. After the coating operation, when it is desirable to clean the coating machine, the pneumatic cylinder and rod are used to move the offset roll out of the way for cleaning and the like and then when the pneumatic cylinder and rod are activated to move the offset roll back into the exact position that the roll had for coating before the cleaning operation, the micrometer control operates to allow the roll to be lowered to the extent that the first button stop and the second button stop interface to stop the movement of the adjustable stop block, which in turn stops the movement of the sliding block, which in turn stops the movement of the offset roll at precisely the position that the offset roll had, relative to the coating roll, prior to the removal of the offset roll for cleaning.

That which is claimed is:

1. A pneumatically and micro controlled offset roll in an encasement in a three roll coating machine, said three rolls being said offset roll located in nip defining relationship between a drive roll and a nip roll, said offset roll and controls in combination comprising:

said offset roll comprising a cylinder having an axle through its longitudinal center and extending some distance therebeyond, said cylinder having a hard outer coating;

said axle having mounted near each of its ends thereof, a bearing;

each end of said axle being rotatably mounted into an L-shaped slide block;

each said slide block being slidably mounted in a slide case, said slide case being fixedly attached in a vertical position on the outside surface of the encasement;

each said slide block having mounted in its upper surface a rod, said rod being a slide rod of a pneumatically driven piston;

said piston being fixedly mounted on the outside wall of the encasement by a first bracket;

each said slide block having fixedly mounted through a leg of said L-shape slide block and essentially in a downwardly configuration, a micrometer adjustment device having an elongated rod fixedly attached to a micrometer adjustment knob on its upper end, said elongated rod being adjustably mounted into an adjustable stop block;

said adjustable stop block having fixedly mounted into its end distal from the inserted, elongated rod, a first button stop;

said encasement having mounted on its lower outside surface, and in supporting alignment with the L-shaped slide block, a second bracket, said second bracket having fixedly mounted on its upper surface, a second button stop in alignment with the first button stop.

* * * * *